US005562397A

United States Patent [19]

Albright

[11] Patent Number: 5,562,397

[45] Date of Patent: Oct. 8, 1996

[54] POWER ACTUATOR FOR ATTACHMENT PLATE

[75] Inventor: Larry E. Albright, Gwinner, N. Dak.

[73] Assignee: Clark Equipment Company, Woodcliff Lake, N.J.

[21] Appl. No.: 274,988

[22] Filed: Jul. 13, 1994

[51] Int. Cl.[6] ..... E02F 3/00

[52] U.S. Cl. ..... 414/723; 37/468

[58] Field of Search ..... 414/723; 37/468; 403/322

[56] References Cited

U.S. PATENT DOCUMENTS

| | | | |
|---|---|---|---|
| 3,204,793 | 9/1965 | Lane | 214/140 |
| 3,269,570 | 8/1966 | Wallberg | 214/131 |
| 3,432,184 | 3/1969 | Tweedy | 280/479 |
| 3,672,521 | 6/1972 | Bauer et al. | 414/723 |
| 3,818,551 | 6/1974 | Coughran, Jr. | 24/243 |
| 4,116,347 | 9/1978 | Uchida | 214/145 A |
| 4,208,163 | 6/1980 | Homgqvist | 414/723 |
| 4,332,094 | 6/1982 | Mieger | 414/723 X |
| 4,442,912 | 4/1984 | Vette | 180/89.15 |
| 4,480,955 | 11/1984 | Andrews et al. | 414/723 |
| 4,545,720 | 10/1985 | Cochran et al. . | |
| 4,586,867 | 5/1986 | Stafford | 414/723 |
| 5,049,027 | 9/1991 | Morrison et al. | 414/723 |
| 5,078,569 | 1/1992 | Cook | 414/723 |
| 5,098,252 | 3/1992 | Sheesley et al. | 414/723 |
| 5,107,610 | 4/1992 | Fusco | 37/103 |
| 5,110,254 | 5/1992 | Aubrey | 414/723 |
| 5,145,313 | 9/1992 | Weyer | 414/723 |
| 5,174,173 | 9/1992 | Fauber et al. | 414/723 |
| 5,403,144 | 4/1995 | Staben, Jr. | 414/723 X |

FOREIGN PATENT DOCUMENTS

| | | |
|---|---|---|
| 814808 | 6/1969 | Canada . |
| 0405813 | 1/1991 | European Pat. Off. . |
| 769160 | 2/1957 | United Kingdom . |

OTHER PUBLICATIONS

Brochure published Aug. 1993 (Kn–25M–893–#7537–F) "Bobcat Forks & Grapples for Agriculture".

*Primary Examiner*—Donald W. Underwood
*Attorney, Agent, or Firm*—Westman, Champlin & Kelly, P.A.

[57] ABSTRACT

A power operator for use with a quick attachment device for front end loaders, which operates on existing manual levers that move locking mechanisms between locked and unlocked positions to either lock in place or release a loader attachment to the attachment frame. The actuator directly connects to pivoting portions of the manual levers and causes the levers to be moved under power between the locked and unlocked positions.

8 Claims, 3 Drawing Sheets

POWER ACTUATOR FOR ATTACHMENT PLATE

BACKGROUND OF THE INVENTION

The present invention relates to a power actuator for quick attachment devices for accessories on skid steer loaders, to permit adaption of normal manually operated quick attachment devices to power operation.

U.S. Pat. Nos.3,732,996 and 3,672,521show quick attachment devices that are carried on the front of a loader arm and are used for quickly attaching and detaching various accessories, such as different types of buckets or grapples. These quick attachment devices have been utilized extensively by Melroe Company, a Business Unit of Clark Equipment Company and sold under the trade name BOBTACH.

Power operated, quick attachment devices have been also advanced in the past, such as the device shown in U.S. Pat. No. 3,269,570. Also a power operated device for backhoes is illustrated in U.S. Pat. No. 5,107,610.

A skid steer loader adapter for an implement mounting plate is shown in U.S. Pat. No .5,098,252 and uses a spring biased mechanism that is biased toward a retracted or released position. An over center wedging mechanism engages hook members to overcome a spring force, and the locking mechanism is forced into engagement with the implement being mounted.

The present invention is made to adapt the BOBTACH system to power operation without substantial modification of the present manual latch levers. This aids in making the device adaptable for retro fitting existing manual operated units.

SUMMARY OF THE INVENTION

This invention relates to a power actuator for a quick attachment mechanism used to automatically connect an implement to an arm of a front end loader, such as a skid steer loader. Specifically, the power operator couples to existing levers for operating wedge members that are used for locking the attachment in place onto the plate mounted on the front end of loader arms on a front end loader.

The opposite ends of the actuator mounts onto the two existing levers on opposite sides of the attachment plate. The attachment plate houses movable wedges that are used for locking an attachment into place on the attachment plate. The wedges are movable from a retracted position, in which the attachment can be slipped onto the attachment plate, to a latching position wherein the wedges are forced through an opening on a bracket on the attachment to positively lock the attachment to the attachment plate.

The power operator disclosed connects directly to the manual levers to move the levers under power. The operator has the option for manually using the manual levers in situations where the power operator is not working, or where for other reasons manual levers are desired to be used for one reason or another.

The present attachment is relatively low cost, simple to attach, and is usable with little rework of standard manual arrangements.

DETAILED DESCRIPTION OF THE PREFERRED EMBODIMENTS

Figure 1:
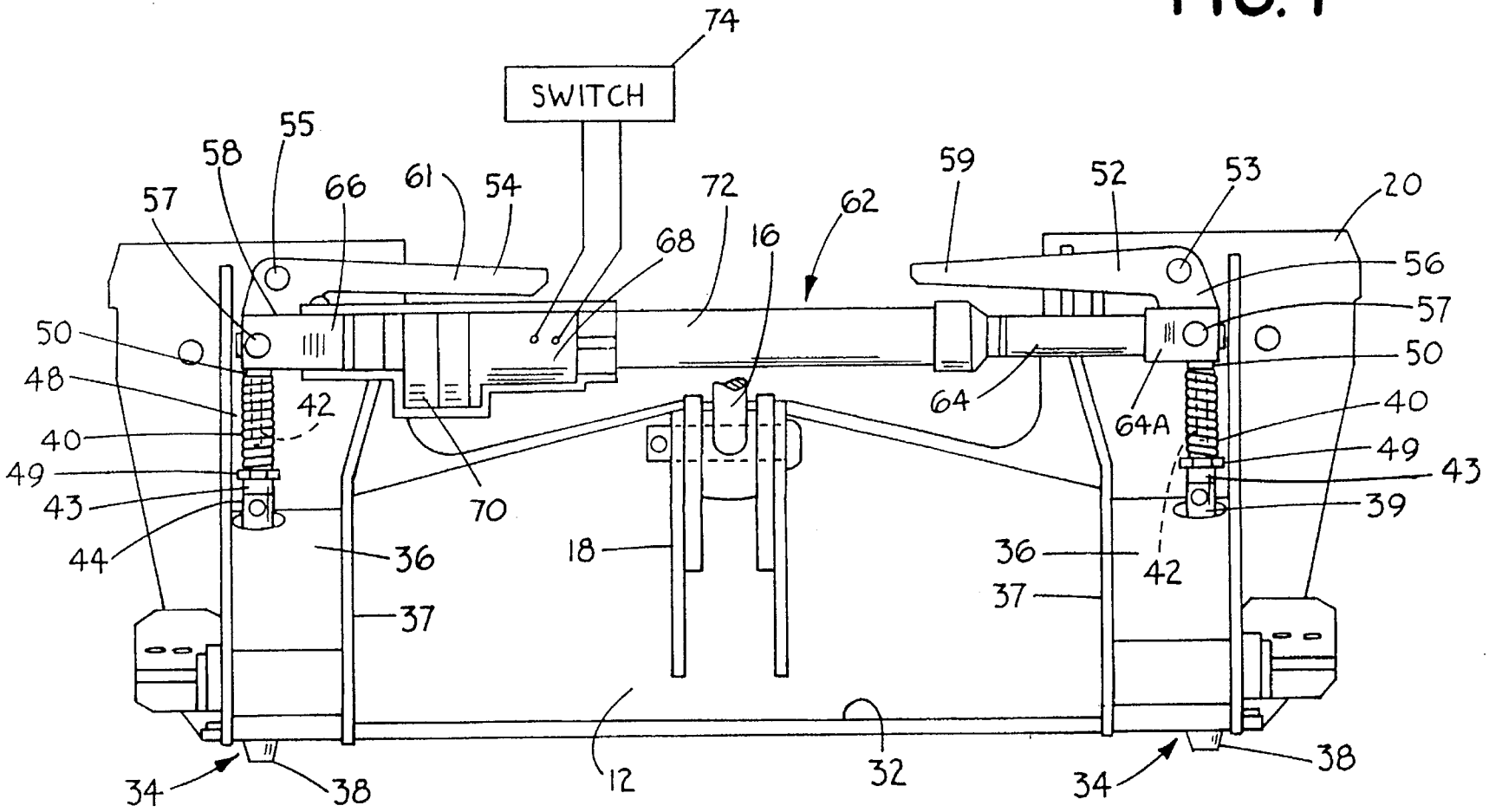
FIG. 1 is an elevational view of an attachment plate having a power operator installed.
Figure 3:
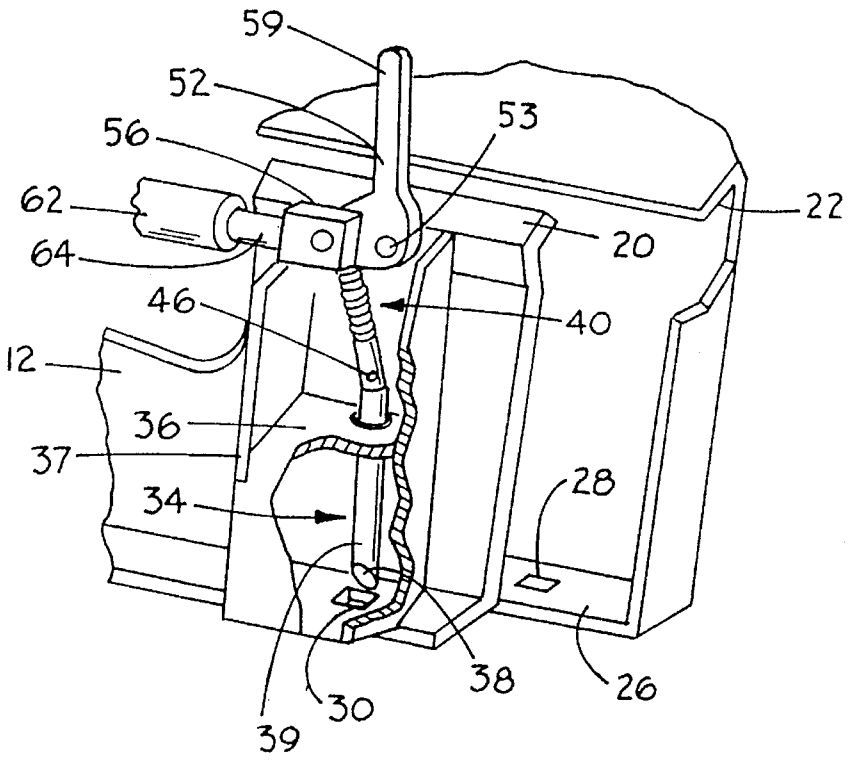
FIG. 3 is a fragmentary perspective view of one end of the mounting plate on the loader arms in position adjacent the attachment to be mounted.
Figure 2:
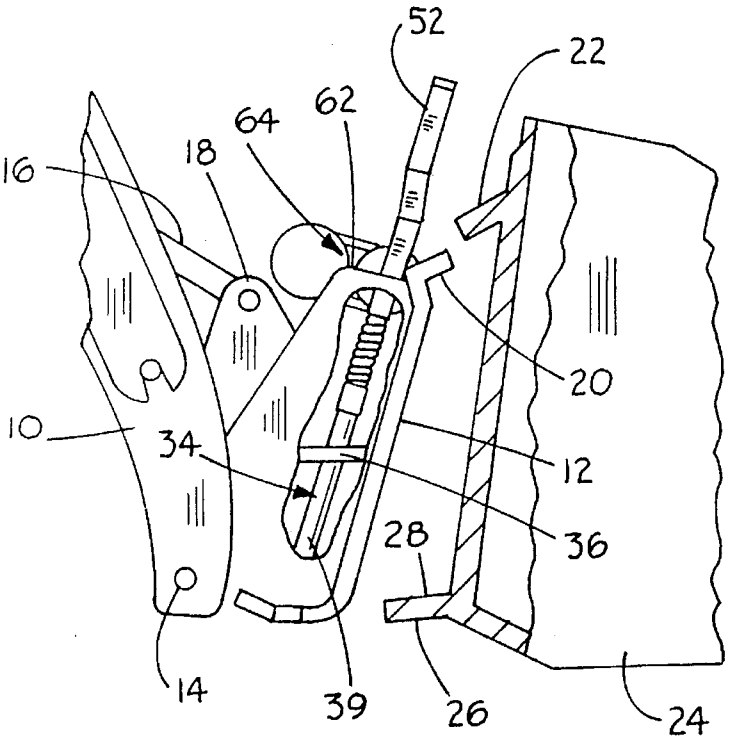
FIG. 2 is a side elevational view of a typical quick attachment system with which the power operator of the present invention is used showing an attachment prior to being positioned on a mounting plate on loader arms.

As shown in FIG. 2, a loader arm 10 of conventional construction has an attachment mounting plate 12 pivotally mounted on the arm about pivots 14. The tilting of the attachment plate 12 is controlled by an actuator, the extendible and retractable rod of which is shown at 16, attached to a suitable bracket 18 on the attachment mounting plate 12. As can be seen in FIG. 2, the attachment mounting plate 12 includes a lip 20 that will fit under a flange 22 on an attachment such as a loader bucket indicated at 24. There is a flange on the lower edge of the back wall on each side of the bucket. One side of the attachment plate is shown for sake of illustration. A lower flange 26 is also supported on the attachment or bucket 24, and as can be seen the lower flange 26 has an aperture 28 that will align with an aperture 30 in a lower support flange 32 of the attachment mounting plate or frame 12. A sliding wedge 34 is mounting in a suitable guide plate (or plates) 36 that forms part of a lever and wedge housing 37 on the attachment mounting plate 12. The wedge will move up or down in a vertical direction. As can be seen, the wedge 34 has a tapered wedge end 38, to aid in pushing the wedge into the desired aperture on the attachment or bucket 24 when it is in position to be mounted. The wedge also has a shaft portion 39 that is slidably guided in suitable guides.

The upper end of shaft portion 39 of wedge 34 is pivotally mounted to a conventional wedge actuator shaft assembly 40, which has a housing 43 at the lower end. The housing 43 has a bifurcated end 44 that receives a pivot pin 46 used for coupling the housing 43 to the end of shaft portion 39 of wedge 34.

A coupling end 50 is connected to a shaft member 42 that is slidably coupled to the housing 43. A spring 48 acts between an adjusting nut 49 and coupling end 50 at the upper end of the telescoping shaft assembly 40. The arrangement is conventional and will load the wedge downward to lock the wedge as well as upward. Thus, it is shown schematically.

The upper ends of each of the shaft assemblies 40 are connected to a separate lever 52 and 54, respectively, on opposite sides of the attachment mounting plate 12. The shaft assemblies 40 and the wedges 34 are identical on the opposite sides of the attachment mounting plate 12, except one is left-handed and one is right-handed. The levers 52 and 54 are pivotally mounted to the attachment mounting plate 12 on suitable pivot supports 53 and 55 respectively. The pivot supports 53 and 55 can be pins using bushings, or relatively low friction connections so that the levers 52 and 54 can pivot freely and easily. The actuator end of the levers 56 and 58, respectively, carry the pivot pins 57 for the connections that control the wedge members 34.

Handles 59 and 61 are provided on the levers 52 and 54 respectively, so that the parts can be manually operated if desired.

In the present invention, the pivot pins 57 are also used for mounting the opposite ends of a power actuator 62. In the form shown the actuator 62 is an electric linear actuator as shown and has a first shaft 64 that has a bushing end 64A which mounts to the pivot pin 57 coupled the lever 52. A base connector 66 mounts to the pin 57 coupled to the lever 54.

The electric motor driven linear power actuator 62 includes an electric motor 68 that operates in a known manner through a gear box 70 to drive an internal screw that will tend to extend or retract the end screw driven shaft 64 relative to the housing 72. The end 66 is fixed to the housing 72 with a clamp and brackets, or it could be a second screw that also extends when motor 68 is driven. The electric motor 68 is driven through a switch 74 which can be mounted in the operator's cab of a skid steer loader or other prime mover with which the actuator is utilized.

In operation, the power actuator 62 will be retracted so that the wedges 34 are raised and the attachment plate or frame 12 is moved adjacent to the attachment 24 in the same manner as is done conventionally. The attachment frame 12 is tilted forwardly so that the lip 20 is placed under the attachment flanges 22. The rod 16 of the tilt cylinder on the skid steer loader is retracted and the bottom portion of the attachment frame will move into the receptacle formed above the lower flanges 26 on the attachment. The attachment frame 12 is positioned with the wedges 34 aligned with the respective apertures 28 so that the wedges 34 will be in position to lock in place.

When the power actuator 62 is retracted, the levers 52 and 54 are in position as shown by the lever 52 in FIG. 2, with the handles 59 and 61 straight up, and the wedges 34 retracted.

Figure 5:
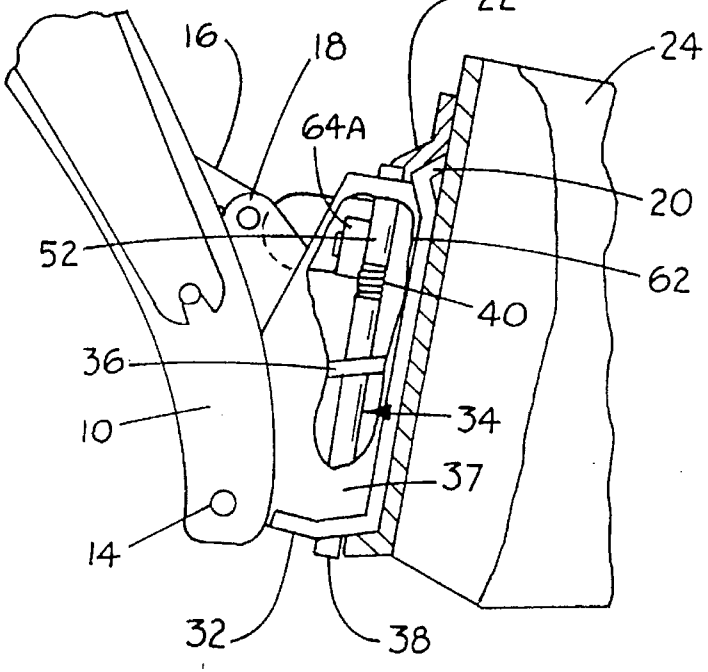
FIG. 5 is a side view of the attachment plate of the loader with parts in section and parts broken away to show the locking levers in position.
Figure 4:
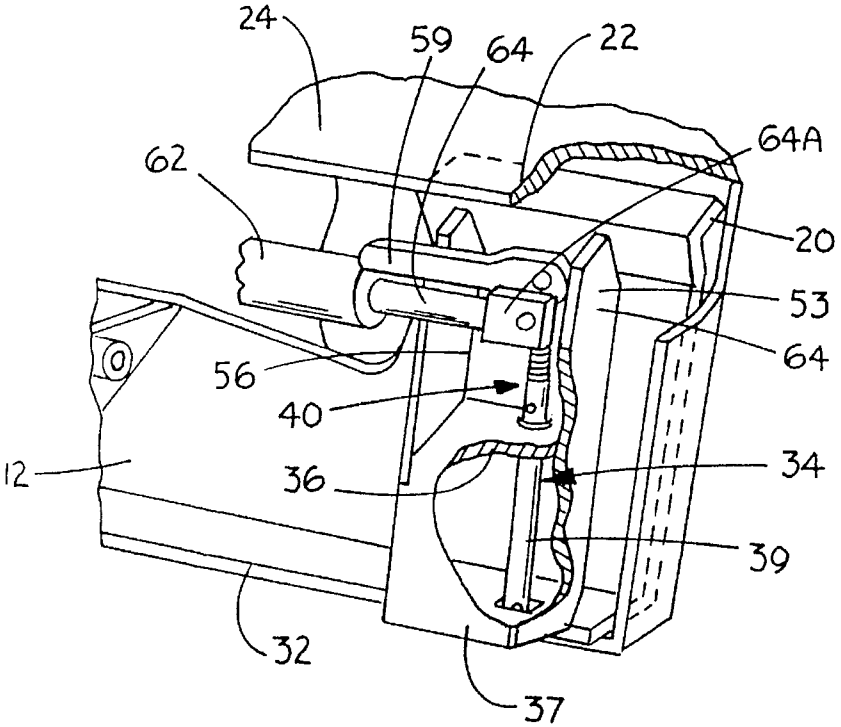
FIG. 4 is a view showing the attachment mounted on the plate, with a locking wedge in place to hold the attachment in place.

Once the attachment frame 12 has been put into position relative to flanges 22 and 26, the power actuator 62 can be operated to extend the end screws 64 and 66 and thus extend the length of the actuator, and move the two levers 52 and 54 toward their locked position shown in FIGS. 4 and 5. The lever 52 will pivot counter clockwise, and the lever 54 will pivot clockwise until the wedges 34 are forced through the apertures 28 on the flange 26 of the 24 attachment, such as a loader bucket or other attachment, to positively lock the attachment into position on the attachment frame 12. Then, the actuator motor can be turned off, either automatically by an "end of stroke " or "wedge position " sensor or by releasing the switch 74, and the loader can be used in its normal manner.

To release the attachment 24, the actuator 62 is operated in an opposite direction to retract the end shafts 64 and shorten the actuator length. The pins 57 are pulled toward each other to pivot the levers 52 and 54 to the position shown in FIG. 2, with the wedges 34 raised up out of the apertures 28 on the flanges 26 of the attachment 24, after which the attachment frame 12 can be tilted forwardly to pull the bottom portion of the frame 12 away from the flange 26. Lowering the attachment frame 12 will pull the lip 20 away from the flange 22 for complete release.

The electric linear actuator 62 illustrated is an easily controlled device, that can be adapted for use on a wide range of front end loaders. The actuator would be connected into the electrical system of the loader and controlled by an operator in the operator's cab. If the actuator has screws or retractable rods at its opposite ends, the housing 72 can be fixed to the attachment plate or frame. If only one end screw or rod extends, the actuator would be mounted on and extend between the pivots 57.

A hydraulic actuator can also be utilized, by hooking the base end to one of the pins 57 and the rod end to the other of the pins 57 and then connecting the hydraulic cylinder to valves that are for remote attachments on a loader.

The term actuator thus means any kind of power actuator that provides for extension and retraction under control of an operator to cause pivoting of the manual levers and lifting or lowering of the wedges from the retracted position to the working position and in reverse direction. The unit is easy to install and can be adapted to retro fit existing units having the levers 52 and 54 as shown, as a kit, and can permit either manual or power operation as desired. Manual operation is possible by removing the actuator 62 or disengaging the actuator ends from pins 57.

Although the present invention has been described with reference to preferred embodiments, workers skilled in the art will recognize that changes may be made in form and detail without departing from the spirit and scope of the invention.

What is claimed is:

1. A power operated apparatus to latch an attachment to a loader arm including an attachment frame, the attachment frame including a latch that slidably moves to a latched position to hold an implement on the attachment frame and a pivoting lever pivotally mounted on the attachment frame at a first pivot for operating the latch between latched and unlatched positions, said lever having an end pivotally mounted to said latch at a second pivot with a pivot pin, and a manual lever portion extending from the first pivot in a different direction than toward the second pivot, the power operated apparatus comprising a power operated extendable and retractable member mounted on the attachment frame and connected to the pivot pin between the lever and the latch, and operable for causing the lever to pivot about the first pivot under power operation to move the latch between its latched and unlatched positions.

2. A power operated apparatus to latch an attachment to a loader arm, including an attachment frame, the attachment frame including a pair of latches on opposite sides of the attachment frame, each latch slidably moving to a latched position to hold an implement, and a separate pivoting lever pivotally mounted on the attachment frame adjacent each latch for operating the respective adjacent latch between latched and unlatched positions, said levers each having an end pivotally mounted to its respective adjacent latch at a pivot, the power operated apparatus comprising a power operated extendable and retractable member mounted on the attachment frame and having opposite ends, one of the ends of the extendible and retractable member being connected to the pivot between one latch and one of the levers and the other end of the extendible and retractable member being connected to the pivot between the other latch and the other lever, whereby extending and retracting the extendible and retractable member causes both of the levers to pivot and both of the latches to move between their respective latched and unlatched positions.

3. The apparatus of claim 2 wherein said actuator comprises an electrically driven linear actuator, and a switch remote from the linear actuator for operating the linear actuator.

4. In a quick attachment device for attaching an accessory attachment mechanism to an attachment frame mounted on a loader arm, wherein said quick attachment device includes interlocking lips on the accessory attachment mechanism and attachment frame at an upper end of the attachment frame and interfitting brackets on the attachment mechanism and attachment frame at a lower end of the attachment frame, respectively, and a wedge which fits into an aperture on the bracket on the attachment frame and through an aligning aperture on the bracket on the attachment mechanism and which is slidably mounted on the attachment frame, a manual lever mechanism pivotally mounted on the attachment frame and having a manual handle portion and a lever portion spaced from the handle portion and pivotally coupled to the wedge at a second pivot whereby movement of the lever about its pivot on the attachment frame causes the wedge to move between latched and unlatched positions, the improvement comprising a power actuator pivotally connected to the lever portion at the second pivot spaced from the manual handle portion to move the lever portion to latch and unlatch the wedge under power operation.

5. The improvement of claim 4 wherein the actuator is an electric linear actuator.

6. The apparatus of claim 1, wherein the slidable latch comprises a slidable wedge.

7. A power operated apparatus to latch and unlatch an attachment to a loader arm, including an attachment frame, the attachment frame having a pair of laterally spaced latches that slidably move between a latched position and a retracted unlatched position, a separate pivoting lever for operating each latch, each lever being mounted for pivotal movement on the attachment frame and each lever including an operating handle portion and a lever portion, the respective lever portions being pivotally mounted to operate the respective latch and upon pivoting of the levers operable to move the latches between latched and unlatched positions, and a power operator mounted to the pivots between the lever portions and the respective latches, the power operator being extendable and retractable to cause the levers to pivot about the pivots of the levers to the attachment frame and thereby move the lever portions to operate the latches between latched and unlatched positions.

8. The apparatus of claim 7, wherein the power operator is an electric linear actuator.

* * * * *

UNITED STATES PATENT AND TRADEMARK OFFICE

CERTIFICATE OF CORRECTION

PATENT NO. : 5,562,397

DATED : October 8, 1996

INVENTOR(S) : Larry E. Albright

It is certified that error appears in the above-indentified patent and that said Letters Patent is hereby corrected as shown below:

On the title page,
Under [56] References Cited
U.S. Patent Documents

Please change Patent No. "5,174,173" to
--5,147,173--

Signed and Sealed this

Fourth Day of March, 1997

*Attest:*

Bruce Lehman

BRUCE LEHMAN

*Attesting Officer*

*Commissioner of Patents and Trademarks*